United States Patent [19]

Yoo et al.

[11] 3,945,914

[45] Mar. 23, 1976

[54] PROCESS FOR "SULFUR REDUCTION OF AN OXIDIZED HYDROCARBON BY FORMING A METAL-SULFUR-CONTAINING COMPOUND"

[75] Inventors: Jin Sun Yoo; Andrew P. Voss, both of South Holland, Ill.

[73] Assignee: Atlantic Richfield Company, Philadelphia, Pa.

[22] Filed: Aug. 23, 1974

[21] Appl. No.: 499,885

[52] U.S. Cl. ..... 208/208 R; 208/240; 208/243; 208/244; 208/246; 208/247

[51] Int. Cl.[2] ..... C10G 29/04; C10G 29/06; C10G 27/04

[58] Field of Search ..... 208/189, 190, 193, 196, 208/201, 207, 243, 244, 246, 247, 208 R, 240

[56] References Cited

UNITED STATES PATENTS

| | | | |
|---|---|---|---|
| 2,671,049 | 3/1954 | Brown | 208/189 |
| 3,595,778 | 7/1971 | Smetana et al. | 208/208 R |
| 3,719,589 | 3/1973 | Herbstman et al. | 208/208 R |
| 3,816,301 | 6/1974 | Sorgenti | 208/208 R |

*Primary Examiner*—Delbert E. Gantz
*Assistant Examiner*—G. J. Crasanakis
*Attorney, Agent, or Firm*—Frank J. Uxa

[57] ABSTRACT

A process for reducing the sulfur content of hydrocarbon material by oxidizing the sulfur impurities contained in the hydrocarbon material, contacting the oxidized sulfur-containing hydrocarbon material with at least one of certain metal containing components at conditions to form a metal, sulfur-containing compound and recovering a hydrocarbon material of reduced sulfur content.

14 Claims, No Drawings

PROCESS FOR "SULFUR REDUCTION OF AN OXIDIZED HYDROCARBON BY FORMING A METAL-SULFUR-CONTAINING COMPOUND"

The present invention relates to an improved process for reducing the sulfur content of hydrocarbon materials. More particularly, the invention relates to the reduction in sulfur-content of hydrocarbon materials involving the oxidation of sulfur impurities contained therein.

Petroleum crude oils and topped or reduced crude oils as well as other heavy hydrocarbon fractions and/or distillates are contaminated by the presence of excessive concentrations of various impurities which detrimentally affect various processes to which such fractions may be subjected. Among the known nonmetallic impurities is sulfur which exists in hetero-atomic compounds which have proven difficult to remove by conventional processing. The sulfur in these hydrocarbon fractions is objectionable, for example, because combustion of fuel containing this impurity results in the release of sulfur oxides which are noxious, corrosive, and, therefore, present a serious problem with respect to pollution of the atmosphere.

The prior art is replete with methods for removing the sulfur compounds. One known method involves oxidation of the hydrocarbon material followed by treating the oxidized hydrocarbon at elevated temperatures to reduce the sulfur content of the hydrocarbon material. This method has proven to be of only limited utility since only a rather low degree of desulfurization is achieved. Therefore, it would be advantageous to develop a process which gives an increased degree of desulfurization.

Therefore, one of the primary objects of the present invention is to provide a process for the production of a hydrocarbon material having reduced sulfur content.

Another object of the present invention is to provide a process for the improved desulfurization of sulfur-containing hydrocarbon materials. Other objects and advantages will become apparent hereinafter.

A process has now been discovered for producing a hydrocarbon material of reduced sulfur content which comprises:

1. contacting a sulfur-containing hydrocarbon material with an oxidant to preferentially oxidize at least a portion of the sulfur and form an oxidized sulfur-containing hydrocarbon material;
2. contacting the oxidized sulfur-containing hydrocarbon material with at least one additional metal-containing component at a temperature within the range from about 500°F. to about 1350°F., preferably from about 650°F. to about 1000°F., and more preferably from about 700°F. to about 850°F., to form a metal-sulfur-containing compound, the additional metal-containing component comprising a metal selected from the group consisting of nickel, molybdenum, cobalt, tungsten, iron, zinc, vanadium, copper, manganese, mercury and mixtures thereof; and
3. recovering a hydrocarbon material of reduced sulfur content.

This invention involves the processing of various sulfur-containing hydrocarbon materials, such as those derived from petroleum sources. In general, the sulfur content of these materials may be greater than about 1% by weight. In many instances these hydrocarbon materials contain a significant amount of thiophene sulfur which is known to be difficult to remove. Typical examples of hydrocarbon materials which are suited to the present process include heavy hydrocarbon materials such as petroleum fractions containing at least a major amount of material boiling above about 550°F., for example, crude oil and atmospheric and vacuum residues which contain about 1% by weight or more of sulfur. Additional examples of suitable hydrocarbon materials include cracked gas oils, residual fuel oils, topped or reduced crudes, crude petroleum from which the lighter fractions are absent, residues from cracking processes and sulfur-containing hydrocarbon materials from tar sands, oil shale and coal. The invention is particularly suited to those sulfur-containing heavy hydrocarbon materials which cannot be deeply flashed without extensive carry over of sulfur-containing compounds. Typical examples of the 2,3,4,and 5-ring thiophene-containing materials found in heavy hydrocarbon materials which are difficult to remove include benzothiophene, dibenzothiophene, 5-thia-3,4-benzofluorene, tetraphenyl-thiophene, diacenaphtho (1,2-b, 1′,2′-d) thiophene and anthra (2,1,9-cde) thianaphthene. The hydrocarbon material may also contain non-thiophene sulfur, various sulfides, and elemental sulfur which can be removed by the process of the present invention.

The sulfur in the hydrocarbon material may be oxidized using any conventional oxidant which is able to chemically oxidize at least a portion of the sulfur contained in the hydrocarbon material. It is preferred that the oxidant preferentially oxidize the sulfur rather than the hydrocarbon portion of the hydrocarbon material. By this is meant that the oxidation preferably occurs without substantial oxidation of carbon atoms to form, for example, ketones, carboxyl acids or other carbonyl-containing compounds. Included among the oxidants which may be used for such oxidation are oxygen (often in the form of oxygen-containing gases, e.g., air) ozone, hydrogen peroxide, organic peroxides, organic hydroperoxides and organic peracids, as well as inorganic peroxy compounds such as inorganic peroxides and the like. The oxidation preferably takes place in the presence of a metal-containing catalyst, described hereinafter.

Thus, the oxidation, i.e., contacting, of step (1), is carried out by contacting the sulfur-containing hydrocarbon material with an oxidant optionally in the presence of a metal-containing catalyst for a time sufficient to effect oxidation of at least a portion of the sulfur present in the hydrocarbon material. The concentration of oxidant is usually dependent upon the percent sulfur present in the hydrocarbon material and, in general, the mole ratio of oxidant to sulfur contained in the hydrocarbon material is from about 0.5 to about 10 atoms of active (i.e., reducable) oxygen per atom of sulfur in the hydrocarbon material, preferably from about 1 to about 8 atoms of active oxygen per atom of sulfur and more preferably from about 1.5 atoms to about 4.0 atoms of active oxygen per atom of sulfur. Oxidants useful in the present invention include those having one, two or more atoms of active oxygen per molecule of oxidant.

The temperature utilized in carrying out the oxidation step can vary over a wide range. Preferably, a temperature within the range from about 20°F. to about 450°F. may be employed, although higher and lower temperatures can be utilized. In general, the sulfur-containing hydrocarbon material is heated with the oxidant for a time sufficient to oxidize at least a portion of the contained sulfur, preferably for a time within the range of from about 5 min. to about 24 hours and more preferably from about one-half hour to about 20 hours. The time that is utilized, in general, depends upon the percent sulfur present and the type and amount of oxidant. The sulfur-oxidizing step of this invention, in general, may be carried out over a broad range of pressures, preferably at a pressure in the range from about 1 atmosphere to about 100 atmospheres or more.

The preferred oxidants which are utilized in carrying out the oxidation step of the process of this invention are organic peroxides, organic hydroperoxides, organic peracids and hydrogen peroxide. These oxidants are particularly preferred since such oxidants have been found to give excellent desulfurization when combined with the contacting of step (2) and recovery of step (3) described hereinafter. In addition, the use of the preferred oxidants has been found to be selective for oxidation of the sulfur, that is, substantial amounts of oxidation products such as carboxyl acids and ketones are not formed. In addition, high product yields in the oxidation step, both as to the high product yield of oxidized sulfur impurities and the high product yield of hydrocarbon material which remains after the oxidation step and, in particular, after the contacting of step (2), are obtained utilizing the preferred oxidants. The organic oxidants include by way of example, hydrocarbon peroxides, hydrocarbon hydroperoxides and hydrocarbon peracids wherein the hydrocarbon radicals in general contain from about 1 to about 30 carbon atoms per active oxygen atom, e.g., per peroxide linkage, and more particularly from 4 to 16 carbon atoms per active oxygen atom. With respect to the hydrocarbon peracids, the hydrocarbon radical is defined as that radical which is attached to the carbonyl carbon and it is preferred that such hydrocarbon radical contain from 1 to about 12 carbon atoms, more preferably from 1 to about 8 carbon atoms, per active oxygen atom. It is intended that the term organic peracide include, by way of definition, performic acid.

In addition, it is contemplated within the scope of this invention that the organic oxidants can be prepared in situ, that is the peroxide, hydroperoxide or peracid can be generated in the sulfur-containing hydrocarbon material and such organic oxidant is contemplated for use within the scope of this invention.

Typical examples of hydrocarbon radicals are alkyl such as methyl, ethyl, butyl, t-butyl, pentyl, n-octyl and those aliphatic radicals which represent the hydrocarbon portion of a middle distillate or kerosene, and the like; cycloalkyl radicals such as cyclopentyl and the like; alkylated cycloalkyl radicals such as mono- and polymethylcyclopentyl radicals and the like; cycloalkyl substituted alkyl radicals such as cyclopentyl methyl and ethyl and the like; aryl and alkyl phenyl substituted alkyl radicals such as benzyl, methylbenzyl, caprylbenzyl, phenylethyl, phenylpropyl, naphthylmethyl, naphthylethyl, and the like; aryl radicals such as xylyl, methyl phenyl, ethyl phenyl and the like.

Typical examples of oxidants are hydroxyheptyl peroxide, cyclohexanone peroxide, t-butyl peracetate, di-t-butyl diperphthalate, t-butyl-perbenzoate, methyl ethyl ketone peroxide, dicumyl peroxide, t-butyl hydroperoxide, di-t-butyl peroxide, p-methane hydroperoxide, pinane hydroperoxide, 2,5-dimethylhexane-2,5-dihydroperoxide, tetrahydronaphthalene hydroperoxide and cumene hydroperoxide as well as organic peracids, such as performic acid, peracetic acid, trichloroperacetic acid, perbenzoic acid and perphthalic acid. The preferred oxidant for use in the present invention is tertiary butyl hydroperoxide.

The catalyst which may be utilized to promote the oxidation of sulfur contained in a hydrocarbon material using the preferred oxidants are catalysts selected from Group IV-B, Group V-B and Group VI-B metals. These catalysts can be incorporated into the present process by any means known to those skilled in the art, and can be included in either a homogeneous or heterogeneous catalyst system. When a homogeneous metal-containing oxidation catalyst is employed, it is preferred that the catalyst metal concentration be at least about 5 ppm., more preferably from about 10 ppm. to about 500 ppm. by weight based on the weight of the sulfur-containing hydrocarbon material. In any event, the catalyst metal concentration is such as to promote the preferential oxidation of sulfur in the sulfur-containing hydrocarbon material. The catalyst can be incorporated by a variety of means and by the use of a variety of carriers. The particular catalyst carrier which is utilized is not critical with respect to the practice of this invention and can be, for example, a support medium or an anion (including complex formation) which is attached to the metal (e.g., a ligand). The preferred catalyst metals are titanium, zirconium, vanadium, tantalum, chromium, molybdenum, tungsten and mixtures thereof, with molybdenum being the more preferred catalyst metal. Illustrative ligands include halides, organic acids, alcoholates, mercaptides, sulfonates and phenolates. These metals may be also bound by a variety of complexing agents including acetonylacetonates, amines, ammonia, carbon monoxide and olefins, among others. The metals may also be introduced in the form of organometallics including "ferrocene" type structures. The various ligands illustrated above which are utilized solely as carriers to incorporate the metal into the process system, in general, have an organic radical attached to a functional group such as the oxygen atom of the carbonyloxy group of the acid, the oxygen of the alcohol, the sulfur of the mercaptan, the $$-\overset{\overset{\displaystyle O}{\|}}{S}-O-$$

of the sulfonate, the oxygen of the phenolic compound and the nitrogen of the amines. The organic radical attached to the aforedescribed functional groups can be defined as a hydrocarbon radical and, in general, can contain from 1 to about 30 carbon atoms. Typical examples of hydrocarbon radicals are set forth above.

Various covalent peroxide complexes, with or without ligands, of suitable metals are also effective oxidation catalysts. The preferred ligands are hexa methyl phosphoamide, octamethyl phosphonamide, trialkyl-, triaryl,- and triaralkylphosphines and phosphine oxides, pyridine oxide, pyridine, 2,2'-bipyridine, dimethylforamide, dimethylacetamide, and tetramethylurea.

The metals contained in either the homogeneous or heterogeneous catalyst useful in the present invention can include an individual metal or combination of metals. These metals can be supported on or chemically combined with a suitable material, for example, natural or synthetic alumina, silica (or combinations of both), organic polymers containing trivalent phosphorus and/or nitrogen as well as activated clays or carbon, among others. The modes of contacting the hydrocarbon material with a heterogeneous catalyst whereby the catalytic effect may be achieved may include slurry-bed reactions or continuous contacting over a stationary phase in a trickle-tube reactor or other conventional methods.

A particularly preferred catalyst for carrying out the oxidation step of the process of this invention is a molybdenum-containing catalyst prepared by a method which comprises interacting molybdenum metal with a compound selected from the group consisting of organic peroxide, organic hydroperoxide, organic peracid, hydrogen peroxide and mixtures thereof in the presence of at least one saturated alcohol having from one to four carbon atoms per molecule to solubilize at least a portion of the molybdenum metal. It is believed that the molybdenum metal interacts with the peroxy compound to form a soluble molybdenum-containing product.

Typical peroxides, hydroperoxides, and peracids useful in the preparation of the preferred molybdenum-containing catalyst have been described previously as oxidants and, therefore, no further exemplification is required. These peroxy compounds may also be substituted with groups such as halides, $-NH_2$, $-SH$,

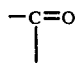

and the like which do not interfere with the catalyst forming process. The most preferred peroxy compound for use in preparing this molybdenum-containing catalyst is tertiary butyl hydroperoxide.

Hydrogen peroxide suitable for preparing the preferred molybdenum-containing catalyst is preferably used in the form of an aqueous solution containing, for example, from about 10% to about 60%, preferably about 30%, by weight of hydrogen peroxide.

Typical examples of low molecular weight monohydroxy alcohols which are suitable for use in the preparation of the preferred molybdenum-containing catalyst include methyl alcohol, ethyl alcohol, isopropyl alcohol, n-butyl alcohol and tertiary butyl alcohol. The low molecular weight polyhydroxy alcohols which are suitable include ethylene glycol, propylene glycol, 1,2-butylene glycol and glycerol. In general, either mono- or poly-hydroxy alcohols containing from 1 to 4 carbon atoms per molecule are suitable. In the present invention, it is preferred that the molybdenum metal be interacted with tertiary butyl hydroperoxide in the presence of tertiary butyl alcohol. If tertiary butyl alcohol is used as the saturated alcohol, it is preferred, to enhance molybdenum solubility, that the interaction mixture comprise at least one mono- or poly-hydroxy alcohol having from 1 to about 16 carbon atoms per molecule, at least one primary hydroxy group, and present in an amount from about 1% to about 25% by weight of the total alcohol.

Typically, the peroxy compound comprises from about 5% to about 50% by weight of the total peroxy compound and alcohol used in catalyst preparation.

The molybdenum concentration in the catalyst mixture, i.e., the mixture comprising the interaction product of the metallic molybdenum and peroxy compound plus any excess peroxy compound and the low molecular weight alcohol, often may be within the range from about 5 ppm. to about 5.0%, preferably in the range from about 30 ppm. to about 2.0% by weight of the total mixture. It may be desirable to prepare the catalyst in the presence of a solvent such as benzene, tertiary butyl alcohol, ethyl acetate and the like, in order to obtain the optimum molybdenum concentration in the final catalyst mixture. However, if this type of dilution is desired, it is preferred that an excess of tertiary butyl alcohol be maintained in the catalyst mixture for this purpose.

The molybdenum metal useful in the preparation of the particularly preferred molybdenum-containing catalyst may be in the form of lumps, sheets, foil or powder. The powdered material, e.g., having a particle size such that it passes through a 50 mesh sieve, preferably through a 200 mesh sieve, on the Standard Screen Scale, is preferable because of its lower cost and in addition, it offers the greatest surface area per unit volume and, therefore, the fastest rate of solubilization.

The molybdenum metal-peroxy compound interacting may be carried out at a wide range of temperatures, for example, within the range from about 25°C. to about 100°C. Interacting pressures should be set to avoid extensive vaporization of the peroxy compound and alcohol. Typical interacting pressures may range from about 1 psia. to about 100 psia. In many instances, atmospheric pressure may be used. After the interacting has been carried out for a desired length of time, e.g., from about 5 minutes to about 30 hours, the reaction mass may be filtered to separate the insoluble molybdenum from the catalyst mixture which mixture is thereafter suitable for use as a catalyst for the oxidation of sulfur impurities in hydrocarbon materials.

Following the oxidation step, the hydrocarbon material may be separated from lower boiling materials, such as oxidant decomposition products, solvent, various catalyst components, cracked hydrocarbons and the like. Some sulfur-containing compounds may also be removed at this point. This separation may be performed using conventional procedures, such as flashing, stripping, simple distillation and the like procedures. Alternately the entire oxidation reaction mass may be used in the contacting of step (2) of the present process.

After at least a portion of the sulfur in the hydrocarbon material has been oxidized, the oxidized sulfur-containing to invention. hydrocarbon material is contacted with at least one additional metal-containing component at conditions to form a compound containing the metal and sulfur. The additional metal-containing component comprises metal selected from the group consisting of nickel, molybdenum, cobalt, tungsten, iron, zinc, vanadium, copper, manganese, mercury and mixtures thereof. By "additional metal component" is meant that the oxidized sulfur-containing hydrocarbon material is contacted with metal component which was not present in the contacting step (1). The ratio of metal containing component to oxidized sulfur-containing hydrocarbon material may vary over a broad range. Thus, it is within the scope of the present invention th have, for example, additional molybdenum component introduced into a molybdenum containing oxidized sulfur-containing hydrocarbon material prior to and/or during the contacting of step (2) of the present invetion. In a preferred embodiment, the contacting of step (2) takes place in the essential absence of added free molecular hydrogen.

The above-noted step (2) takes place at conditions so that at least one compound containing a metal selected from the group consisting of nickel, molybdenum, cobalt, tungsten, iron, zinc, vanadium, copper, manganese, mercury and mixtures thereof and sulfur is formed. Step (2) contacting temperatures range from about 500°F. to about 1350°F., preferably from about 650°F. to about 1000°F., and more preferably from about 700°F. to about 850°F. While carrying out this contacting of step (2), it is preferred to maintain a sufficient pressure in the contacting zone so as to maintain a major portion of the oxidized sulfur-containing hydrocarbon material in the liquid phase. Typical contacting pressures may be within the range from about atmospheric pressure to about 2000 psig., preferably from about 300 psig. to about 1000 psig. Contacting time may range, for example, from about 5 minutes to about 20 hours, preferably from about 10 minutes to about 8 hours, and more preferably from about 30 minutes to about 2 hours.

Although the concentration of additional metal component present in the contacting of step (2) may vary over a broad range, it is preferred that at least about 0.1, e.g., about 0.1 to about 20.0 or more, more preferably from about 0.5 to about 15.0 and still more preferably from about 1.0 to about 12.0, equivalents of at least one additional metal-containing component comprising a metal selected from the group consisting of nickel, molybdenum, cobalt, tungsten, iron, zinc, vanadium, copper, manganese, mercury and mixtures thereof, which component is capable of chemically combining with sulfur at step (2) contacting conditions, be present per equivalent of sulfur in the oxidized sulfur-containing hydrocarbon material. The preferred metal for use in this contacting step of the present invention is selected from the group consisting of molybdenum, cobalt, iron, tungsten, vanadium and mixtures thereof. The more preferred metal is molybdenum.

As with the oxidation catalysts noted previously, the metals useful in the contacting of step (2) of the present invention can be present during this treating in any form provided that it is capable of performing its function, i.e., forming a metal-sulfur-containing compound. The particular metal vehicle which is utilized is not critical and can be, for example, a support medium or an anion (including complex formation) which is attached to the metal, e.g., a ligand. Thus, the metal-containing component for use in the treating step may include elemental metal, elemental metal or metal-containing compounds, e.g., oxide, supported on a catalyst carrier, e.g., alumina, soluble metal-containing compounds and the like. In this manner, the metal useful in the contacting of step (2) may exist in a phase distinct from the oxidized sulfur-containing hydrocarbon material, i.e., a heterogeneous system, or it may be present as part of a homogeneous system.

Included among the ligands which may be used as carrier for the metal present during the contacting of step (2) are halides, organic acids, alcoholates, phenolates and the like. These metals may also be bound by a variety of complexing agents including acetonylacetonates, amines, ammonia, carbon monoxide and olefins among others. The metals may also be introduced in the form of organometallics including "ferrocene" type structures.

Various covalent peroxide complexes, with or without ligands, of suitable metals are also effective metal-containing components for use in the present invention. The preferred ligands are hexamethyl phosphoamide, octamethyl phosphonamide, trialkyl-, triaryl-, and triaralkyl-phosphines and phosphine oxides, pyridine oxide, pyridine, 2,2'-bipyridine, dimethylforamide, dimethylacetamide, and tetramethylurea.

The metals contained in either the homogeneous or heterogeneous contacting system can include an individual metal or combination of metals. These metals can be supported on a suitable material, for example, natural or synthetic alumina, silica (or combinations of both) as well as activated clays or carbon, among others. The modes of contacting the oxidized sulfur-containing hydrocarbon material in a heterogeneous system may include slurry-bed treatment zones or continuous treating using a fixed bed, ebulatting bed, moving bed or fluidized bed of particles comprising the metal-containing component or other conventional methods.

In one particularly advantageous aspect of the present invention, it has been found that the particularly preferred molybdenum-containing oxidation catalyst can be beneficially utilized in the contacting of step (2). To illustrate this aspect of the invention, the oxidation can be carried out in the presence of the particularly preferred oxidation catalyst and additional catalyst can be added to the oxidized sulfur-containing hydrocarbon material prior to and/or during the contacting of step (2). Of course, this catalyst need not be used to promote the oxidation. However, in order to achieve the maximum benefits of the present invention, it is preferred that the particularly preferred oxidation catalyst be utilized in both the contacting of steps (1) and (2) of the present invention.

In many instances, for example, if the contacting of step (2) described above occurs in a homogeneous or slurry-bed reaction system (rather than over, for example, a fixed bed of particles comprising the metal-containing component) the contacted hydrocarbon material can be separated from the metal-sulfur-containing component formed during contacting as well as from any unused metal-containing component and component support. This operation may involve a liquid-solid separation such as filtration, settling and the like. In any event, a hydrocarbon material having reduced sulfur content can be obtained from the contacted hydrocarbon material by conventional procedures, for example, flashing, stripping, distillation and the like.

If desired, for improved processing efficiency, the metal, sulfur-containing component formed in the contacting of step (2) can be chemically converted to a metal-containing component useful in this contacting step. In other words, the metal-containing component useful in the present invention can be regenerated for reuse. For example, the metal, sulfur-containing component formed in the contacting of step (2) can be exposed to an oxidizing atmosphere, e.g., air, to convert the sulfur-containing component to a metal oxide component suitable for use in step (2) of the present invention.

The following examples illustrate more clearly the process of the present invention. However, these illustrations are not to be interpreted as specific limitations on the invention.

EXAMPLES I TO III

These examples illustrate the improved desulfurization of hydrocarbon material which results from practicing the process of the present invention.

The hydrocarbon material employed was a propane soluble portion of a petroleum vacuum still residuum (initial boiling point - 610°F., 15% overhead - 962°F.). This hydrocarbon material was obtained by propane deasphalting the residuum using a propane to residuum volume ratio of 7:1. Two separate deasphalting operations (i.e., extractions) were performed on the residuum. The propane was stripped from the extract and the resulting hydrocarbon material had the following composition.

| | Weight %* |
|---|---|
| Sulfur | 1.73 |
| Nitrogen | 0.155 |
| Carbon | 85.80 |
| Hydrogen | 12.135 |

*Proportions listed here result from a series of independent analysis and, therefore, the sums of the weight percent is slightly different from 100.

A soluble, i.e., homogeneous, oxidation catalyst was prepared by combining 0.74 weight percent molybdenum powder with tertiary butyl hydroperoxide in the presence of tertiary butyl alcohol and a mixture of $C_{10}$ to $C_{15}$ glycols containing from 4 to 6 hydroxyl groups per molecule wherein at least one of the hydroxyl groups was primary. The weight ratio of tertiary butyl hydroperoxide to tertiary butyl alcohol to glycols was about 2.1:4.1. This combination was heated to about 60°C. with constant stirring and maintained at this temperature for about 1.5 to 2 hours until all the molybdenum has dissolved.

Tertiary butyl alcohol was used as a solvent in the oxidation reaction and was present in an amount such that the weight ratio of tertiary butyl alcohol to the hydrocarbon material was about 1.3.

The oxidation reaction mixture was formed by combining the hydrocarbon material, tertiary butyl alcohol, catalyst and tertiary butyl alcohol hydroperoxide with constant stirring to insure uniformity. This mixture contained 3.0 moles of tertiary butyl hydroperoxide per mole of sulfur and 166 ppm. of molybdenum.

This reaction mixture was placed in a glass reaction flask equipped with heating means, stirrer and a water cooled condenser. The flask was heated to about 180°F. which caused the reaction mixture to reflux. This temperature was maintained for 8 hours to effect sulfur oxidation. After this period of time, the product in the flask was stripped free of essentially all tertiary butyl alcohol and lighter components.

The oxidized sulfur-containing hydrocarbon product was divided into three portions. One portion of this material was combined with di-phenyl ether to form a mixture containing 35% by weight of the hydrocarbon material and 65% by weight of di-phenyl ether. This mixture was heated to a temperature ranging from 750°F. to 780°F. and maintained at this temperature for 1¼ hours. Throughout this period of time, the pressure within the closed vessel was maintained at 600 psig. through the use of hydrogen gas. At the time of 1¼ hours the liquid product was sampled and analyzed for sulfur content. It was determined that the above processing, i.e., oxidation and thermal treatment, had removed 70% of the sulfur which was originally contained in the propane soluble portion of the vacuum residuum.

A second portion of the product from the oxidation reaction was placed in a 300 cc. autoclave along with an amount of di-phenyl ether and molybdenum oxide supported on silica, so as to form a mixture of 30% by weight of oxidized hydrocarbon product, 61% by weight di-phenyl ether and 8% by weight molybdenum oxide supported on silica.

The molybdenum oxide supported on silica was prepared as follows:

A mixture of 36.4% by weight commercially available silica gel (particle size less than 8 mesh), 4.8% by weight $(NH_4)_6MO_7O_{24}$ .4 $H_2O$ and 58.8% by weight water was formed. This mixture was let stand at room temperature under a vacuum for a period of 3 hours to equilibrate. The mixture was then dried in a rotary evaporator until the solid product was free flowing and apparently dried. This solid product was further dried at 230°F. in a force draft oven and then calcined in an electric muffle furnace fitted with a controller program to heat at a rate of 300°F. per hour to 900°F. The solid product was maintained for 6 hours at 900°F. and cooled rapidly to room temperature. The final calcined molybdenum oxide silica product contained 0.96% by weight volatile mixture at 1200°F. and 9.7% by weight molybdenum oxide, calculated as $MoO_3$.

The mixture noted above was heated to a temperature range from 750°F. to 785°F. for 1¼ hours. During this period of time, the pressure within the closed vessel was maintained at 800 psig. by hydrogen gas. At the end of this period of time, a liquid sample was removed from the autoclave and analyzed for sulfur content. It was determined that the above processing had removed 84% of the sulfur which was originally contained in the propane soluble portion of the vacuum residuum.

A third portion of the product from the oxidation reaction was placed in a 300 cc. autoclave along with an amount of di-phenyl ether and iron oxide (conventionally used to synthesize ammonia) so as to form a mixture of 39% by weight of oxidized hydrocarbon product, 47% di-phenyl ether and 14% by weight iron oxide.

This mixture was heated to a temperature in the range from 530°F. to 800°F. for 1 hour with the pressure within the closed vessel being maintained at 300 psig. by nitrogen gas. The mixture was further treated by heating to a temperature from 800°F. to 870°F. for 55 minutes with the pressure within the closed vessel being maintained at 600 psig. by hydrogen gas. The above processing removed 79% of the sulfur which was originally contained in the propane soluble portion of the vacuum residuum.

These examples illustrate that the present process, which involves the use of a metal-containing component such as molybdenum oxide supported on silica and iron oxide results in a significant improvement in the degree of desulfurization obtainable by oxidation of the sulfur impurities in a hydrocarbon material.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A process for producing a hydrocarbon material of reduced sulfur content which comprises:

1. contacting a sulfur-containing hydrocarbon material with an oxidant to preferentially oxidize at least a portion of the sulfur and form an oxidized sulfur-containing hydrocarbon material, a major amount of said sulfur-containing hydrocarbon material boils above about 550°F.;
2. contacting said oxidized sulfur-containing hydrocarbon material with at least one metal or metal-containing compound at a temperature within the range from about 500°F. to about 1350°F., to form a metal-sulfur-containing compound, said metal or metal-containing compound comprising a metal selected from the group consisting of nickel, molybdenum, cobalt, tungsten, zinc, vanadium, copper, manganese, mercury and mixtures thereof; and
3. recovering a hydrocarbon material from step (2) of reduced sulfur content.

2. The method of claim 1 wherein said metal or metal-containing compound is present in an amount to provide at least about 0.1 equivalent of said metal capable of chemically combining with sulfur at the conditions of step (2) per equivalent of sulfur in said oxidized sulfur-containing hydrocarbon material.

3. The process of claim 2 wherein said oxidant is selected from the group consisting of organic peroxides, organic hydroperoxides, organic peracids and mixtures thereof containing from 1 to about 30 carbon atoms per active oxygen atom and is present during said contacting in an amount to provide from about 0.5 to about 10 atoms of active oxygen per atom of sulfur in said sulfur-containing material and said step (1) contacting occurs in the presence of an oxidation catalyst comprising a metal in an amount effective to promote the oxidation of sulfur, said metal being selected from the group consisting of Group IVB metals, Group VB metals, Group VIB metals and mixtures thereof.

4. The method of claim 3 wherein said contacting of step (2) occurs at a temperature within the range from about 650°F. to about 1000°F.

5. The process of claim 4 wherein said contacting of step (2) occurs over a period of time from about 5 minutes to about 20 hours.

6. The process of claim 5 wherein said oxidation catalyst comprises a metal selected from the group consisting of titanium, zirconium, vanadium, tantalum, chromium, molybdenum, tungsten and mixtures thereof and is present in an amount of at least about 5 ppm. by weight of said sulfur-containing hydrocarbon material.

7. The process of claim 6 wherein said metal or metal-containing compound comprises a metal selected from the group consisting of molybdenum, cobalt, tungsten, vanadium and mixtures thereof, and is present in an amount from about 0.5 to about 15 equivalent of said metal capable of chemically combining with sulfur at the conditions of step (2) per equivalent of sulfur in said oxidized sulfur-containing hydrocarbon material.

8. The process of claim 7 wherein said oxidation catalyst comprises molybdenum.

9. The process of claim 7 wherein said metal or metal-containing compound comprises molybdenum.

10. The process of claim 8 wherein said oxidation catalyst is prepared by a method which comprises interacting molybdenum metal with a compound selected from the group consisting of organic hydroperoxide, organic peroxide, hydrogen peroxide and mixtures thereof in the presence of at least one saturated alcohol having from one to four carbon atoms per molecule at conditions such that at least a portion of said molybdenum is solubilized.

11. The process of claim 10 wherein said metal or metal-containing compound is prepared by a method which comprises interacting molybdenum metal with a compound selected from the group consisting of organic hydroperoxide, organic peroxide, hydrogen peroxide and mixtures thereof in the presence of at leaast one saturated alcohol having from one to four carbon atoms per molecule at conditions such that at least a portion of said molybdenum is solubilized.

12. The process of claim 9 wherein said oxidation catalyst is prepared by a method which comprises interacting molybdenum metal with a compound selected from the group consisting of organic hydroperoxide, organic peroxide, hydrogen peroxide and mixtures thereof in the presence of at least one saturated alcohol having from one to four carbon atoms per molecule at conditions such that at least a portion of said molybdenum is solubilized.

13. The process of claim 12 wherein said metal or metal-containing compound is prepared by a method which comprises interacting molybdenum metal with a compound selected from the group consisting of organic hydroperoxide, organic peroxide, hydrogen peroxide and mixtures thereof in the presence of at least one saturated alcohol having from one to four carbon atoms per molecule at conditions such that at least a portion of said molybdenum is solubilized.

14. The process of claim 13 wherein said contacting of step (2) occurs at a temperature within the range from about 700°F. to about 850°F. and for a period of time from about 30 minutes to about 2 hours.

* * * * *